US007322327B1

(12) United States Patent
Kim

(10) Patent No.: US 7,322,327 B1
(45) Date of Patent: Jan. 29, 2008

(54) LUBRICATION STRUCTURE OF CAMSHAFT WITH VARIABLE VALVE TIMING

(75) Inventor: Suc Tae Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/646,106

(22) Filed: Dec. 26, 2006

(30) Foreign Application Priority Data

Nov. 1, 2006 (KR) ..... 10-2006-0107478

(51) Int. Cl.
*F01M 1/06* (2006.01)

(52) U.S. Cl. ..... 123/90.34; 123/90.16; 123/90.27

(58) Field of Classification Search ..... 123/90.15, 123/90.16, 90.17, 90.18, 90.27, 90.31, 90.34
See application file for complete search history.

(56) References Cited

U.S. PATENT DOCUMENTS 6,032,629 A * 3/2000 Uchida ..... 123/90.34

FOREIGN PATENT DOCUMENTS

| | | | |
|---|---|---|---|
| JP | 63-100205 | | 5/1988 |
| JP | 06-159020 | | 6/1994 |
| JP | 08-200022 | | 8/1996 |
| JP | 10-231712 | | 9/1998 |
| JP | 11-303615 | | 11/1999 |
| JP | 2004-162639 | | 6/2004 |
| KR | 20020041087 | A | 6/2002 |
| KR | 20040031578 | A | 4/2004 |
| KR | 20040033703 | A | 4/2004 |

* cited by examiner

*Primary Examiner*—Ching Chang
(74) *Attorney, Agent, or Firm*—Morgan Lewis & Bockius LLP

(57) ABSTRACT

A lubrication structure for a camshaft with variable valve timing includes an advance hole, which includes an advance flow passage formed in a camshaft body. An end of the camshaft is attached to a continuously variable valve timing. A retard hole, which includes a retard flow passage, is formed in the camshaft body and spaced horizontally from the advance hole. A divergence flow passage has an end that surface-contacts the camshaft and is extended to communicate with the retard hole at an upper surface of a mounting part of a cylinder head. The other end of the divergence flow passage communicates with the slip surface on which the camshaft lays via a counter bore, so as to prevent lubrication film from being broken by load of the sprocket at an engine idle state or at an initial stage of cold starting.

10 Claims, 9 Drawing Sheets

【FIG. 1】
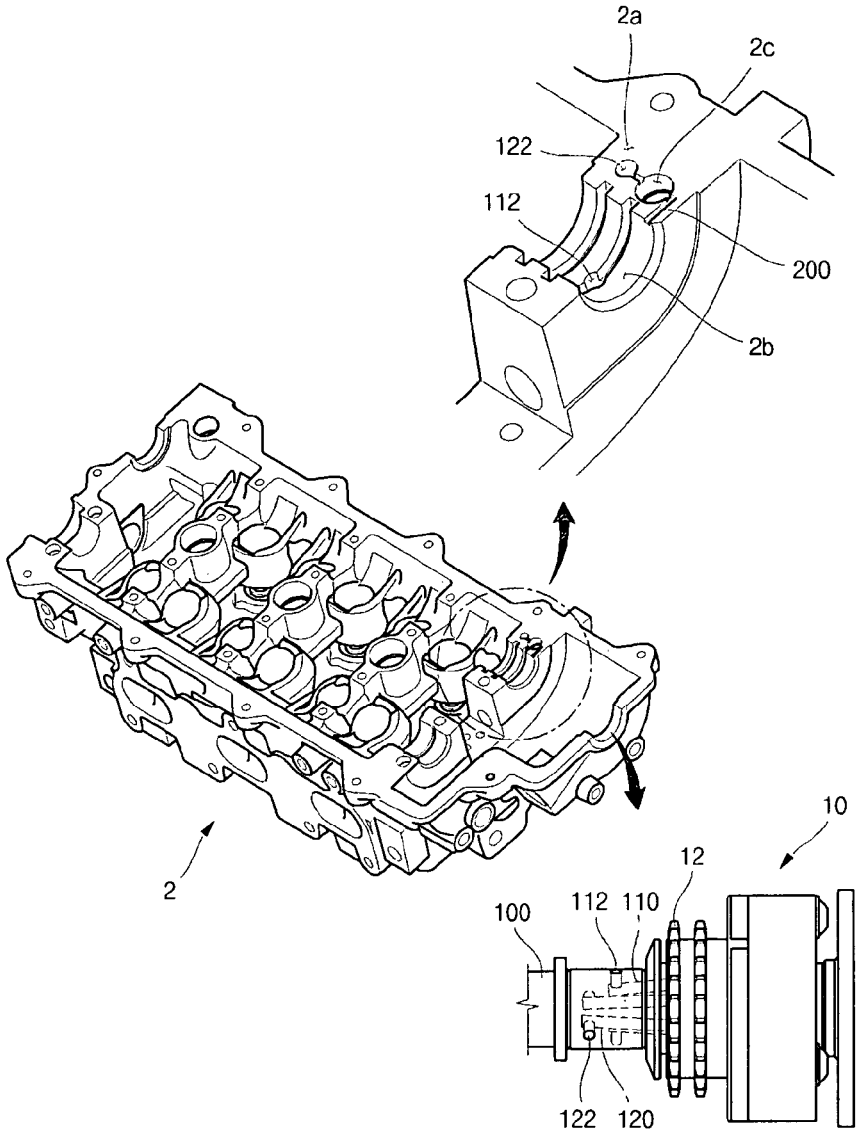

【FIG. 2】
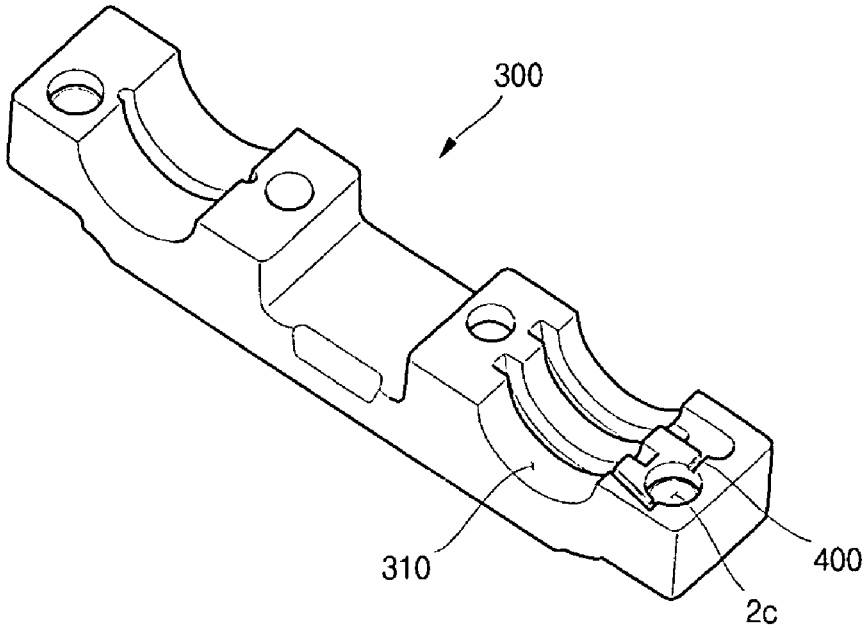

【FIG. 3】
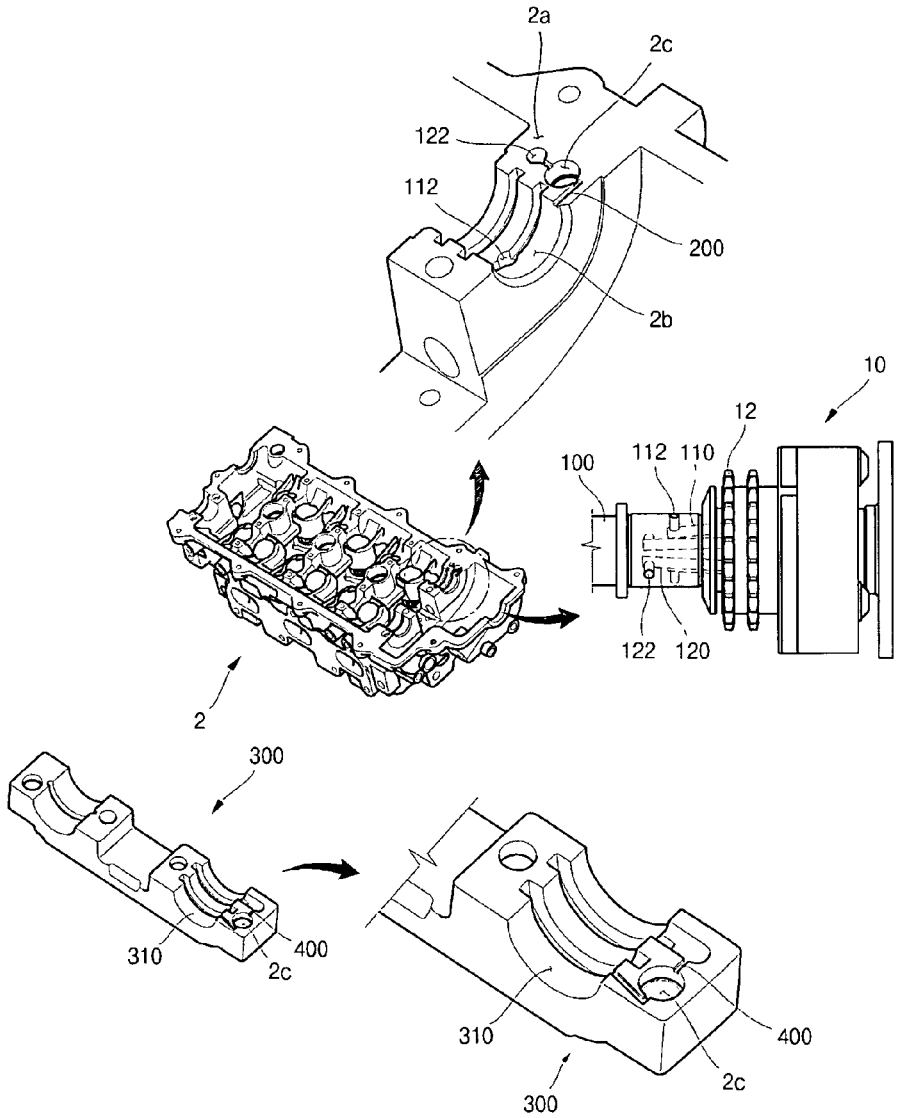

【FIG. 4】
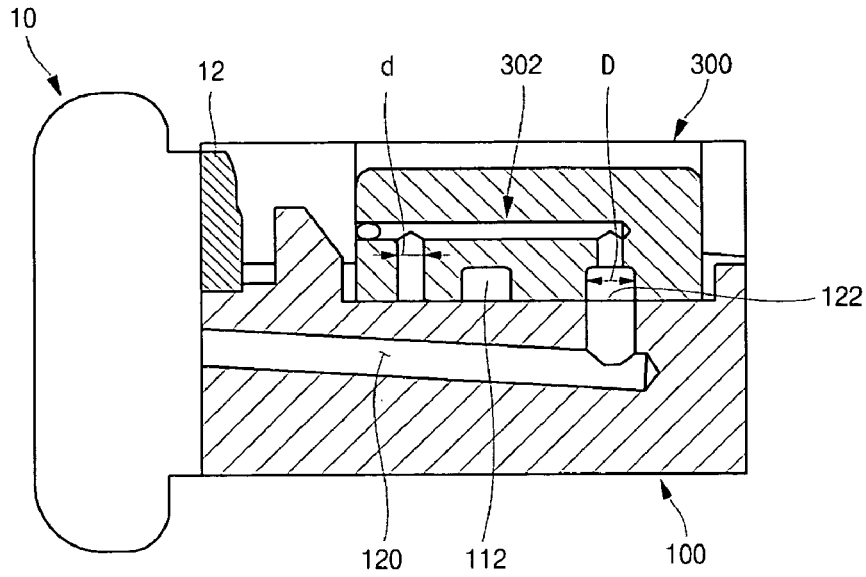
【FIG. 5】
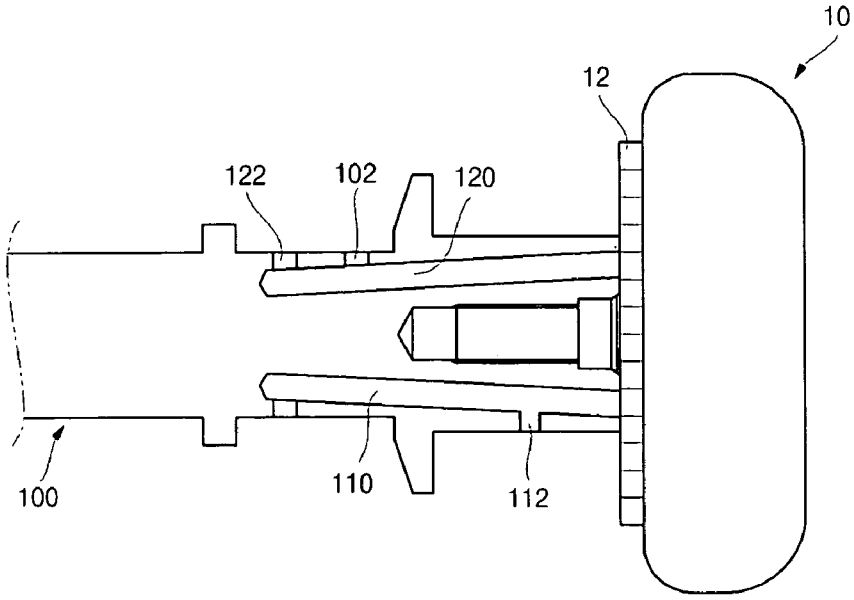

【FIG. 6A】
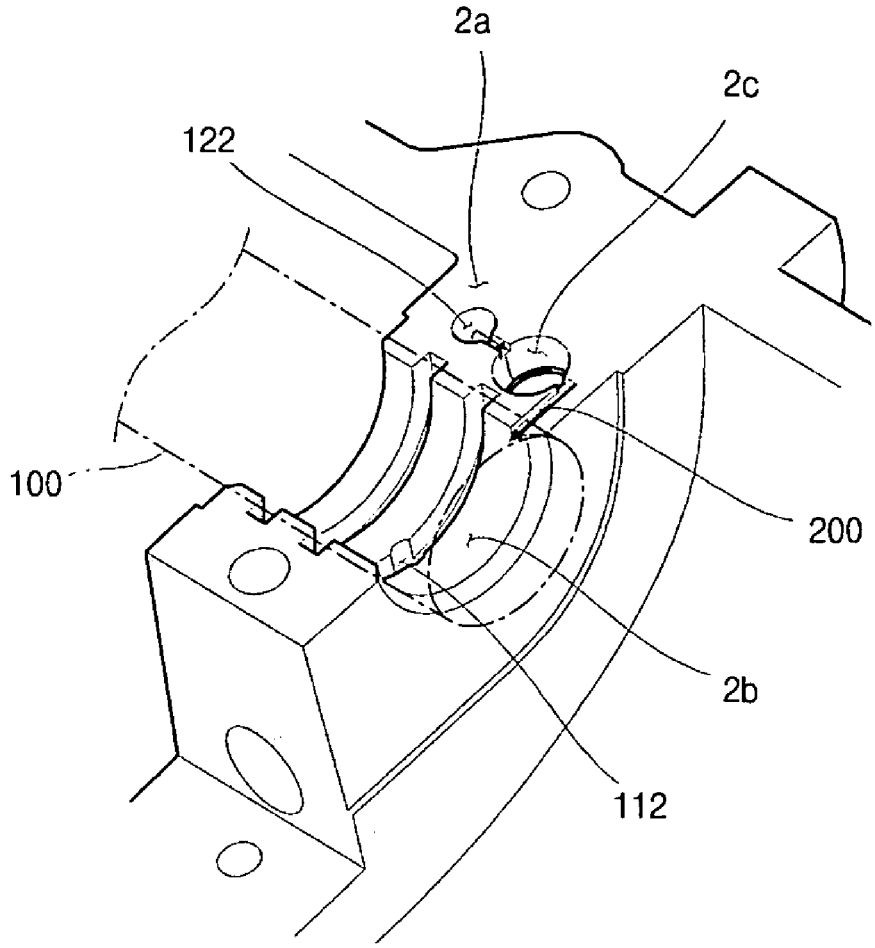

【FIG. 6B】
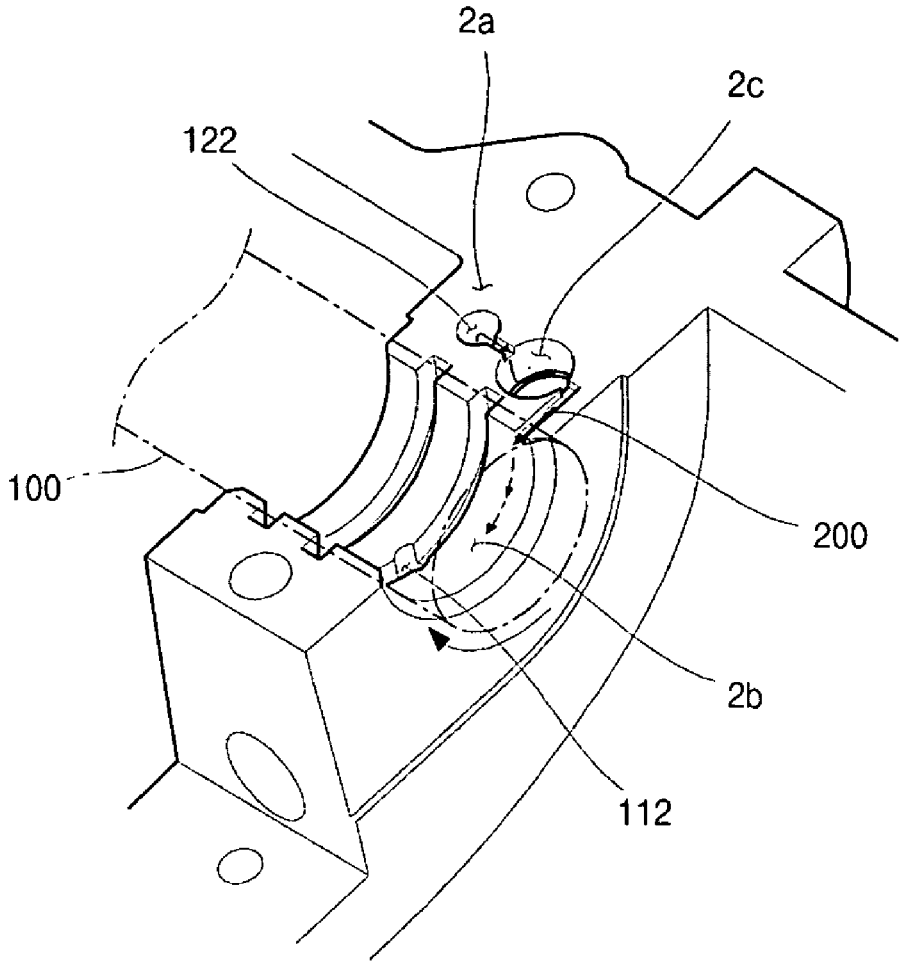

【FIG. 7A】
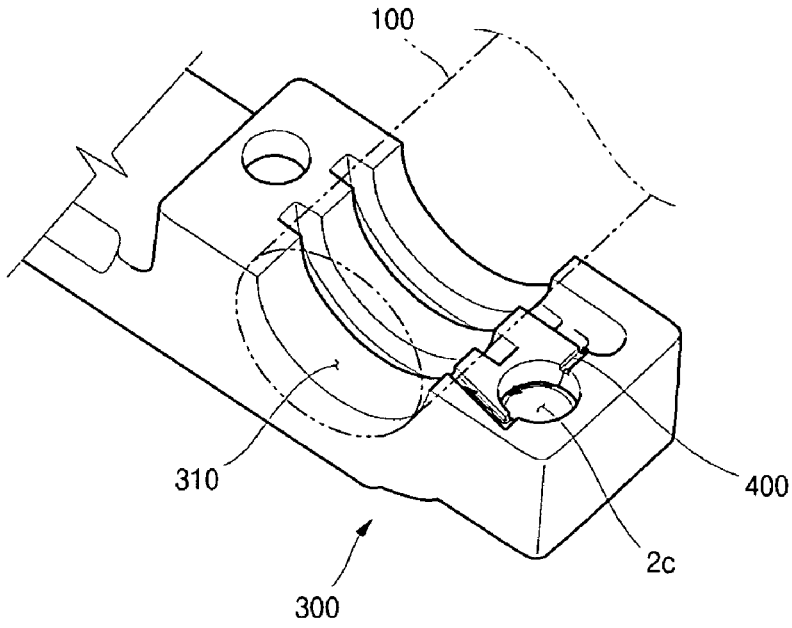
【FIG. 7B】
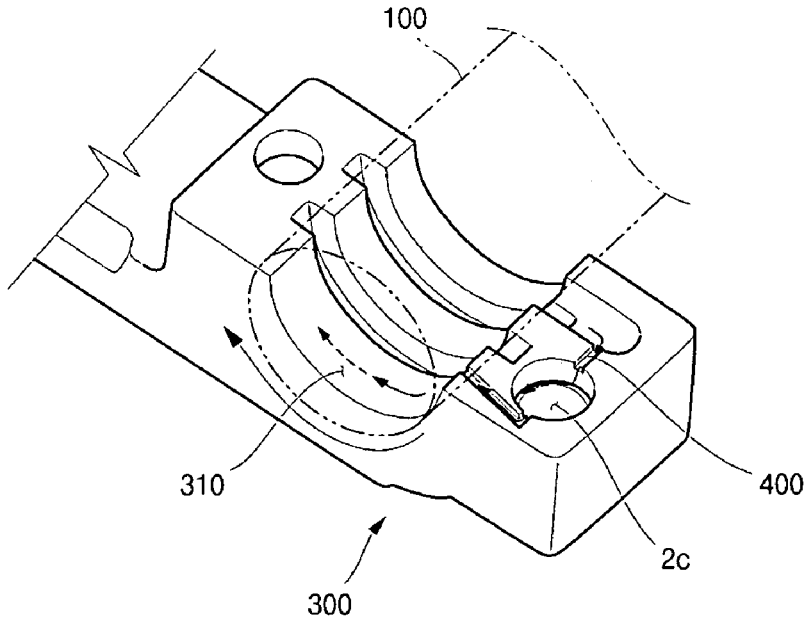

【FIG. 8】
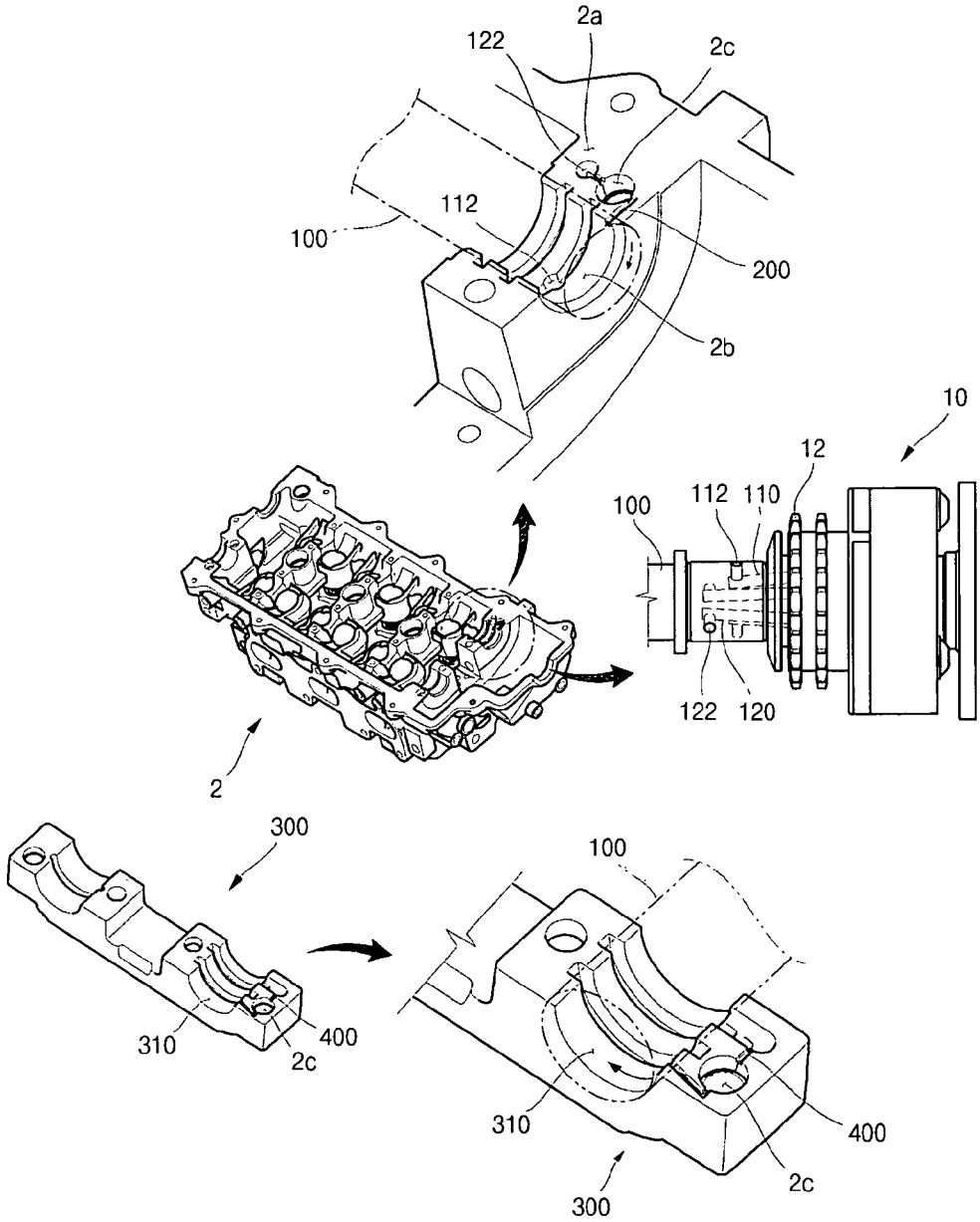

【FIG. 9】
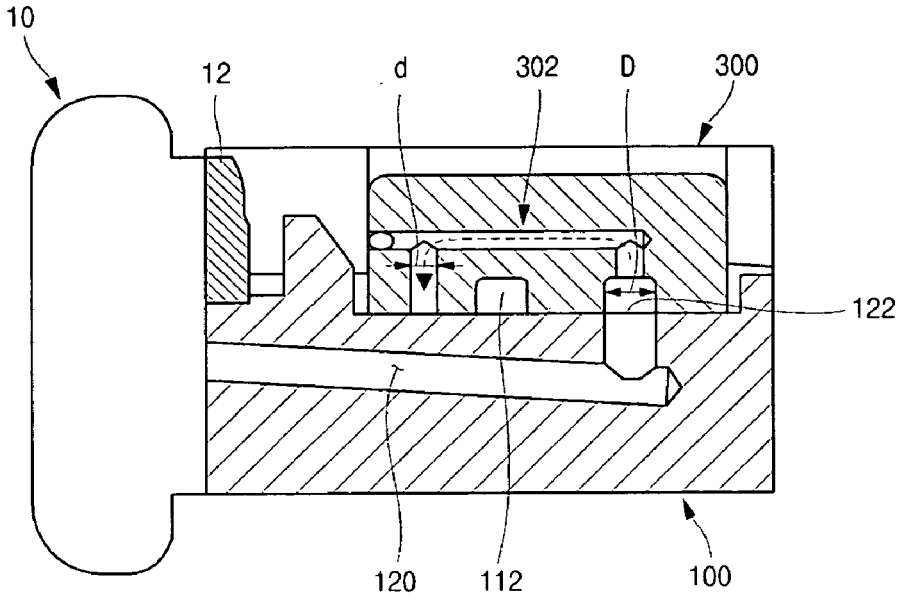
【FIG. 10】
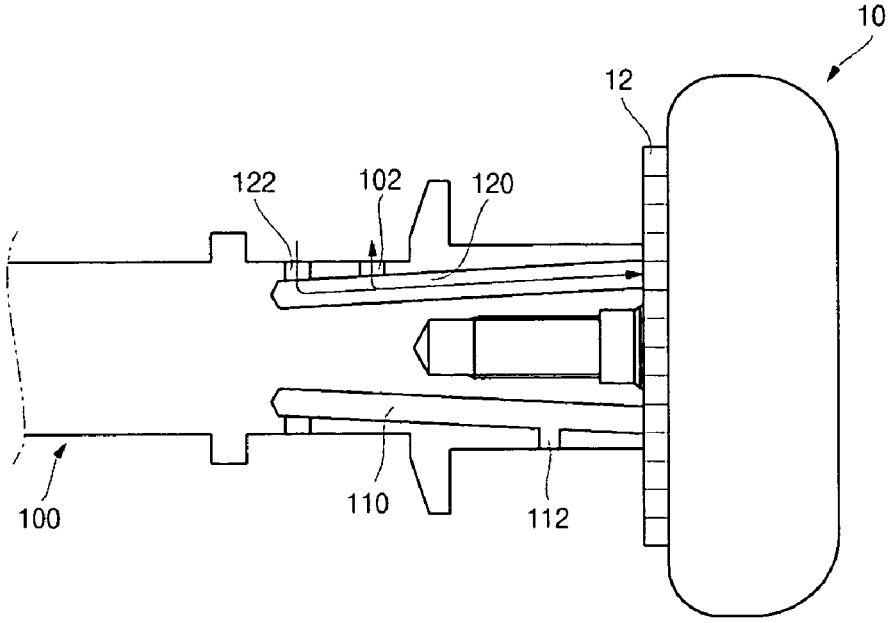

LUBRICATION STRUCTURE OF CAMSHAFT WITH VARIABLE VALVE TIMING

CROSS-REFERENCE TO RELATED APPLICATION

This application claims priority to and the benefit of Korean Patent Application No. 10-2006-0107478 filed in the Korean Intellectual Property Office on Nov. 1, 2006, the entire contents of which are incorporated herein by reference.

BACKGROUND OF THE INVENTION (a) Field of the Invention

The present invention relates to a lubrication structure of a camshaft with a variable valve timing.

(b) Description of the Related Art

Generally, in order to enhance an efficiency of an engine, it is required to vary opening/closing timing of valves depending on an engine speed. In particular, opening/closing timing of an intake valve is a factor having a significant effect on a volumetric efficiency. If the intake valve is opened in advance, a valve overlap period becomes long so that intake and exhaust inertia flow can be sufficiently used at a high speed, and accordingly a volumetric efficiency is enhanced, but at a low speed, a volumetric efficiency is deteriorated because of increase of remained gas so that amount of exhausted HC gas is increased.

In order to solve this problem, continuously variable valve timing (CVVT) has been introduced in order to varying opening/closing timing of an intake valve. A continuously variable valve timing assembly includes a hydraulic circuit for advancing or retarding timing of an intake camshaft by hydraulic pressure controlled by an oil pump and an oil-flow control valve.

The continuously variable valve timing assembly is generally connected to a camshaft, and oil delivered from a cylinder block is supplied to a retard flow passage and an advance flow passage through a retard hole and an advance hole which are formed in the camshaft so as to perform lubrication.

However, oil pressure and lubrication at an advanced side at which the advance hole is formed is insufficient at an initial stage of cold starting or an engine idling, and a journal of the camshaft may be damaged by load by a sprocket which is connected to the camshaft. That is, adherence due to insufficient lubrication of the camshaft may occur.

SUMMARY OF THE INVENTION

Embodiments of the present invention provide a lubrication structure of a camshaft with a variable valve timing having advantages of providing sufficient lubrication at an initial stage of cold starting or an engine idling.

An exemplary embodiment of the present invention provides a lubrication structure of a camshaft with a variable valve timing including: an advance hole which includes an advance flow passage formed in a camshaft body near a sprocket, an end of a camshaft being inserted into a continuously variable valve timing accordingly to which the sprocket is provided; a retard hole which includes a retard flow passage formed in the camshaft body to be spaced horizontally from a position of the advance hole; and a divergence flow passage one end of which surface-contacts the camshaft and is extended to communicate with the retard hole at an upper surface of a mounting part of a cylinder head in which a slip surface is formed, and the other end of which communicates with the slip surface on which the camshaft lays via a counter bore, so as to prevent lubrication film from being broken by load of the sprocket which is connected to the camshaft at an engine idle state or at an initial stage of cold starting.

The other end of the divergence flow passage may be positioned above the advance hole.

Another exemplary embodiment of the present invention provides a lubrication structure of a camshaft with a variable valve timing including: an advance hole which includes an advance flow passage formed in a camshaft body near a sprocket, an end of a camshaft being inserted into a continuously variable valve timing assembly to which the sprocket is provided; a retard hole which includes a retard flow passage formed in the camshaft body to be spaced horizontally from a position of the advance hole; and a divergence flow passage which is formed on an upper surface of a mounting part of a cylinder head, one end of which is extended so as to be supplied with oil through the retard hole and to supply oil to a counter bore on an inner surface of a cam cap which surface-contacts the mounting part, the cam cap being disposed, and the other end of which communicates with a slip surface at an inner side of the cam cap which surface-contacts the outside of the camshaft at the counter bore, so as to prevent lubrication film from being broken by load of the sprocket which is connected to the camshaft at an engine idle state or at an initial stage of cold starting.

The other end of the divergence flow passage may be positioned above the advance hole.

Yet another exemplary embodiment of the present invention provides a lubrication structure of a camshaft with a variable valve timing including: an advance hole which includes an advance flow passage formed in a camshaft body near a sprocket, an end of a camshaft being inserted into a continuously variable valve timing assembly to which the sprocket is provided; a retard hole which includes a retard flow passage formed in the camshaft body to be spaced horizontally from a position of the advance hole; and a divergence flow passage which is formed on an upper surface of a mounting part of a cylinder head to which a slip surface surface-contacting the camshaft and on a lower surface of the cam cap which is coupled to the upper surface of the mounting part is formed, one end of which is extended toward a counter bore such that oil supplied through the retard hole can flow, and the other end of which communicates with the slip surface of the mounting part and the slip surface of the cam cap, so as to prevent lubrication film from being broken by load of a sprocket which is connected to the camshaft at an engine idle state or at an initial stage of cold starting.

The other end of the divergence flow passage may be positioned above the advance hole.

Still yet another exemplary embodiment of the present invention provides a lubrication structure of a camshaft with a variable valve timing including: an advance hole which includes an advance flow passage formed in a camshaft body near a sprocket, an end of a camshaft being inserted into a continuously variable valve timing assembly to which the sprocket is provided; a retard hole which includes a retard flow passage formed in the camshaft body to be spaced horizontally from a position of the advance hole; and a divergence hole one end of which communicates with a retard hole and is extended into an inner side of the cam cap at which a contact surface is formed, and the other end of which is opened to a region between a sprocket and the advance hole so as to communicate with the camshaft body.

The divergence hole may be formed to have a diameter less than that of the advance hole or the retard hole.

Another exemplary embodiment of the present invention provides a lubrication structure of a camshaft with a variable valve timing including: an advance hole which includes an advance flow passage formed in a camshaft body near a sprocket, an end of a camshaft being inserted into a continuously variable valve timing assembly to which the sprocket is provided; a retard hole which includes a retard flow passage formed in the camshaft body to be spaced horizontally from a position of the advance hole; and an auxiliary hole which is perforated into the camshaft on the retard flow passage such that oil supplied through the retard hole is supplied to a slip surface of the camshaft.

The auxiliary hole may be formed to have a diameter less than that of the retard flow passage.

BRIEF DESCRIPTION OF THE DRAWINGS

FIG. 1 is an exploded perspective view showing a lubrication structure of a camshaft with variable valve timing according to an exemplary embodiment of the present invention.

FIG. 2 is a perspective, view of a lubrication structure of a camshaft with variable valve timing according to another exemplary embodiment of the present invention.

FIG. 3 is an exploded perspective view showing a lubrication structure of a camshaft with variable valve timing according to yet another exemplary embodiment of the present invention.

FIG. 4 and FIG. 5 are cross-sectional views of a lubrication structure of a camshaft with variable valve timing according to still yet another exemplary embodiment of the present invention.

FIG. 6A and FIG. 6B are perspective views showing operation states of a lubrication structure of a camshaft with variable valve timing according to an exemplary embodiment of the present invention.

FIG. 7A and FIG. 7B are perspective views showing operation states of a lubrication structure of a camshaft with variable valve timing according to another exemplary embodiment of the present invention.

FIG. 8 is an exploded perspective view showing operation states of a lubrication structure of a camshaft with variable valve timing according to yet another exemplary embodiment of the present invention.

FIG. 9 and FIG. 10 are cross-sectional views of a lubrication structure of a camshaft with variable valve timing according to an exemplary embodiment of the present invention.

DETAILED DESCRIPTION OF THE EMBODIMENTS

Exemplary embodiments of the present invention will hereinafter be described in detail with reference to the accompanying drawings.

Referring to FIG. 1, a lubrication structure of a camshaft with variable valve timing according to an exemplary embodiment of the present invention includes: an advance hole 112, which includes an advance flow passage 110 formed in a camshaft body 101 near a sprocket 12, an end of a camshaft 100 inserted into a continuously variable valve timing (CVVT) assembly 10 to which the sprocket 12 is provided; a retard hole 122 which includes a retard flow passage 120 formed in the camshaft body 101 to be spaced horizontally from a position of the advance hole 112; and a divergence flow passage 200, one end of which surface-contacts the camshaft 100 and is extended to communicate with the retard hole 122 at an upper surface of a mounting part 2*a* of a cylinder head 2 in which a slip surface 2*b* is formed, and the other end of which communicates with the slip surface 2*b* on which the camshaft 100 lays via a counter bore 2*c*, so as to prevent lubrication film from being broken by load of the sprocket 12 which is connected to the camshaft 100 at an engine idle state or at an initial stage of cold starting.

The other end of the divergence flow passage 200 is positioned above the advance hole 112.

Referring to FIG. 2, a lubrication structure of a camshaft with a variable valve timing according to another exemplary embodiment of the present invention includes: the advance hole 112 which includes the advance flow passage 110 formed in the camshaft body 101 near the sprocket 12, an end of the camshaft 100 being inserted into the continuously variable valve timing (CVVT) assembly 10 to which the sprocket 12 is provided; the retard hole 122, which includes the retard flow passage 120 formed in the camshaft body 101 to be spaced horizontally from the position of the advance hole 112; and a divergence flow passage 400 which is formed on an upper surface of the mounting part 2*a* of the cylinder head 2, one end of which is extended so as to be supplied with oil through the retard hole 122 and to supply oil to the counter bore 2*c* on an inner surface of a cam cap 300 which surface-contacts the mounting part 2*a*, the cam cap 300 being disposed, and the other end of which communicates with a slip surface 310 at an inner side of the cam cap 300 which surface-contacts the outside of the camshaft 100 at the counter bore 2*c*, so as to prevent lubrication film from being broken by load of the sprocket 12 which is connected to the camshaft 100 at an engine idle state or at an initial stage of cold starting.

The other end of the divergence flow passage 400 is positioned above the advance hole 112.

Referring to FIG. 3, a lubrication structure of a camshaft with a variable valve timing according to yet another exemplary embodiment of the present invention includes: the advance hole 112 which includes the advance flow passage 110 formed in the camshaft body 101 near the sprocket 12, an end of the camshaft 100 being inserted into the continuously variable valve timing (CVVT) assembly 10 to which the sprocket 12 is provided; the retard hole 122 which includes the retard flow passage 120 formed in the camshaft body 101 to be spaced horizontally from the position of the advance hole 112; and a divergence flow passage 500 which is formed on an upper surface of the mounting part 2*a* of the cylinder head 2 to which the slip surface 2*b* surface-contacting the camshaft 100 and on a lower surface of the cam cap 300 which is coupled to the upper surface of the mounting part 2*a* is formed, one end of which is extended toward the counter bore 2*c* such that oil supplied through the retard hole 122 can flow, and the other end of which communicates with the slip surface 2*b* of the mounting part 2*a* and the slip surface 310 of the cam cap 300, so as to prevent lubrication film from being broken by load of the sprocket 12 which is connected to the camshaft 100 at an engine idle state or at an initial stage of cold starting.

The other end of the divergence flow passage 500 is positioned above the advance hole 112.

Referring to FIG. 4, a lubrication structure of a camshaft with a variable valve timing according to still yet another embodiment of the present invention includes: the advance hole 112 which includes the advance flow passage 110 (referring to FIG. 1) formed in the camshaft body 101 near the sprocket 12, an end of the camshaft 100 being inserted into the continuously variable valve timing (CVVT) assembly 10 to which the sprocket 12 is provided; the retard hole 122, which includes the retard flow passage 120 formed in the camshaft body 101 to be spaced horizontally from the position of the advance hole 112; and a divergence hole 302 one end of which communicates with the retard hole 122 and is extended into an inner side of the cam cap 300 at which a contact surface is formed, and the other end of which is opened to a region between the sprocket 12 and the advance hole 112 so as to communicate with the camshaft body.

The divergence hole 302 is formed to have a diameter less than that of the advance hole 112 or the retard hole 122.

Referring to FIG. 5, a lubrication structure of a camshaft with a variable valve timing according to another exemplary embodiment of the present invention includes: the advance hole 112, which includes the advance flow passage 110 (referring to FIG. 1) formed in the camshaft body 101 near the sprocket 12, an end of the camshaft 100 being inserted into the continuously variable valve timing (CVVT) assembly 10 to which the sprocket 12 is provided; the retard hole 122 which includes the retard flow passage 120 formed in the camshaft body 101 to be spaced horizontally from the position of the advance hole 112; and an auxiliary hole 102 which is perforated into the camshaft 100 on the retard flow passage 120 such that oil supplied through the retard hole 122 is supplied to a slip surface of the camshaft 100.

The auxiliary hole 102 is formed to have a diameter less than that of the retard flow passage 120.

Operation states of a lubrication structure of a camshaft with a variable valve timing according to an exemplary embodiment of the present invention will be explained with reference to the drawings.

Referring to FIG. 1 and FIG. 6A, in the case that an engine of a vehicle is in an initial stage of cold staring or in an idle state (temperature of oil is lower than or equal to about 5° C.?), the continuously variable valve timing (CVVT) assembly 10 (referring to FIG. 1) operates, so load due to a chain (not shown), which is connected to the sprocket 12 acts on the sprocket 12. The slip surface 2*b* of the cylinder head 2 (referring to FIG. 1) which surface-contacts the camshaft 100 does not yet have stable lubrication film and oil film thereon at cold starting of a vehicle, and oil is supplied to the continuously variable valve timing through the retard flow passage 120 (referring to FIG. 1). Oil supplied to the retard flow passage 120 flows into the divergence flow passage 200 through the retard hole 122 as shown in arrows in the drawing, and is then supplied to the counter bore 2*c* of the mounting part 2*a*.

Oil supplied to the counter bore 2*c* is supplied to the other end of the divergence flow passage 200 which is extended toward the slip surface 2*b* of the mounting part 2*a* along an inner surface of the counter bore 2*c*. Oil supplied to the other end of the divergence flow passage 200 is supplied to the slip surface 2*b* of the mounting part 2*a* which slides on the camshaft 100.

Referring to FIG. 1 and FIG. 6B, since oil is not supplied through the advance hole 112 at an initial state of cold starting or in an idle state, in order to perform lubrication, lubrication is performed by oil (shown in broken line) which is supplied to the slip surface 2*b* of the mounting part 2*a* via the divergence flow passage 200. As shown in the drawings, insufficient lubrication of an advanced side during cold start is supplemented while the camshaft 100 rotates in a direction of an arrow, and the end portion of the divergence flow passage 200 is positioned at a position higher than the advance hole 112, so adherence of the camshaft 100 and the slip surface 2*b* of the cylinder head 2 due to insufficient oil on the advanced side is prevented.

Referring to FIG. 7A, in another embodiment of the present invention, the divergence flow passage 200 (referring to FIG. 1) is not formed on the mounting part 2*a* (referring to FIG. 1) of the cylinder head 2 (referring to FIG. 1), but the divergence flow passage 400 is formed on a lower surface of the cam cap 300 which is coupled to the mounting part 2*a* of the cylinder head 2, so as to form lubrication film on the camshaft 100 and the slip surface 2*b* (referring to FIG. 1) of the cylinder head 2.

In the case that an engine of a vehicle is in an initial stage of cold staring or in an idle state (temperature of oil is lower than or equal to abo. 5°), the continuously variable valve timing (CVVT) 10 (referring to FIG. 1) operates, so load due to a chain (not shown) which is connected to the sprocket 12 acts on the sprocket 12. The slip surface 2*b* of the cylinder head 2 (referring to FIG. 1) which surface-contacts the camshaft 100 does not yet have stable lubrication film and oil film thereon at cold starting of a vehicle, and oil is supplied to the continuously variable valve timing through the retard flow passage 120 (referring to FIG. 1). Oil supplied to the retard flow passage 120 flows into the divergence flow passage 400 through the retard hole 122 (referring to FIG. 1) as shown in an arrow in the drawing, and is then supplied to the counter bore 2*c*.

Oil supplied to the counter bore 2*c* is supplied to the other end of the divergence flow passage 400 which is extended toward the slip surface 310 along an inner surface of the counter bore 2*c*. Oil supplied to the other end of the divergence flow passage 400 is supplied to the slip surface 310 which slides on the camshaft 100.

Referring to FIG. 7B, since oil is not supplied through the advance hole 112 (referring to FIG. 1), in order to perform lubrication, lubrication is performed by oil (shown in broken line) which has been supplied to the slip surface 310 via the divergence flow passage 400.

As shown in the drawing, insufficient lubrication of an advanced side during cold start is supplemented while the camshaft 100 rotates in a direction of an arrow, and the end portion of the divergence flow passage 400 is positioned at a position higher than the advance hole 112 (referring to FIG. 1), so adherence of the camshaft 100 and the cylinder head 2 due to insufficient oil on the advanced side is prevented.

FIG. 8 shows a lubrication structure of a camshaft with a variable valve timing according to another exemplary embodiment of the present invention. The divergence flow passages 500 which communicate with the slip surface 2*b* of the mounting part 2*a* and the slip surface 310 of the cam cap 300 are respectively formed on an upper surface of the mounting part 2*a* of the cylinder head 2 and on a lower surface of the cam cap 300 which is coupled to the upper surface of the mounting part 2*a*, so as to supply oil.

A lower surface of the camshaft 100 surface-contacts the slip surface 2*b* of the mounting part 2*a*, and an upper surface of the camshaft 100 surface-contacts the slip surface 310 of the cam cap 300. In this state, oil is supplied to the continuously variable valve timing through the retard flow passage 120, and oil supplied to the retard flow passage 120 flows into the divergence flow passage 200 through the retard hole 122 as shown in arrows of the drawing and is then supplied to the counter bore 2*c* of the mounting part 2*a*.

Oil supplied to the counter bore 2*c* is supplied to the other end of the divergence flow passage 500 which is extended toward the slip surface 2*b* of the mounting part 2*a* along an inner surface of the counter bore 2*c*. Oil supplied to the other end of the divergence flow passage 500 is supplied to the slip surface 2*b* of the mounting part 2*a* which slides on the camshaft 100.

Since oil is not supplied through the advance hole 112, in order to perform lubrication, lubrication is performed by oil which has been supplied to the slip surface 2*b* of the mounting part 2*a* via the divergence flow passage 500.

At the same time, oil supplied along the divergence flow passage 500 which is formed on a lower surface of the cam cap 300 is supplied to the slip surface 310 of the cam cap 300 via the counter bore 2*c*, so as to not only form stable lubrication films on the slip surface 2*b* of the cylinder head 2 surface-contacting the camshaft 100 and on the slip surface 310 of the cam cap 300 but also supplement insufficient lubrication of the advanced side due to load acting on the camshaft 100 by the chain connected to the sprocket 12 at an initial stage of cold starting, thereby preventing adherence of the camshaft 100.

Operation states of a lubrication structure of a camshaft with a variable valve timing shown in FIG. 4 will be explained with reference to FIG. 9.

In a state shown in FIG. 9, oil supply to the continuously variable valve timing 10 is performed as follows. Oil flows into the divergence hole 302 of the cam cap 300 through the retard hole 122 as shown in an arrow in the drawing, and is then supplied to a region where the camshaft 100 between the sprocket 12 and the advance hole 112 surface-contacts the cam cap 300, thereby supplementing insufficient lubrication which is caused by that oil is not supplied through the advance hole 112.

Accordingly, insufficient lubrication of an advanced side which is caused by surface-contact between the advance hole 112 and the camshaft 100 and load acting on the camshaft 100 at an initial state of cold starting is supplemented, thereby preventing adherence of the camshaft. In addition, a diameter d of the divergence hole 302 is less than a diameter D of the advance hole 112 or the retard hole 122, so that loss of hydraulic pressure can be prevented.

Operation state of a lubrication structure of a camshaft with a variable valve timing shown in FIG. 5 will be explained with reference to FIG. 10.

As shown in FIG. 10, oil is supplied along the retard flow passage 120 through the retard hole 122 as shown in an arrow of the drawing, and oil is supplied to the auxiliary hole 102 which is branched from the retard flow passage 120 toward the outside of the camshaft 100.

If oil is supplied through the auxiliary hole 102, insufficient lubrication on a cam journal is supplemented so as to form lubrication film at an initial stage of cold starting. A diameter of the auxiliary hole 102 is less than that of the retard flow passage 120, so that loss of hydraulic pressure in a retarded side can be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

As described above, a lubrication structure of a camshaft with a variable valve timing according to exemplary embodiments of the present invention can supplement insufficient lubrication at an engine idle state of at an initial stage of cold starting while maintaining the structure of a continuously variable valve timing, and can prevent damages on a journal of a camshaft or an engine and can prevent adherence by breakdown of lubrication film.

What is claimed is:

1. A lubrication structure for a camshaft with variable valve timing, comprising:

an advance hole including an advance flow passage formed in a camshaft body near a sprocket, an end of the camshaft being inserted into a continuously variable valve timing assembly on which the sprocket is provided;

a retard hole including a retard flow passage formed in the camshaft body spaced horizontally from the advance hole; and a divergence flow passage, one end of which surface-contacts the camshaft and is extended to communicate with the retard hole at an upper surface of a mounting part of a cylinder head in which a slip surface is formed, and the other end of which communicates with the slip surface on which the camshaft lays via a counter bore, so as to prevent lubrication film from being broken by load of the sprocket which is connected to the camshaft at an engine idle state or at an initial stage of cold starting.

2. The lubrication structure of claim 1, wherein the other end of the divergence flow passage is positioned above the advance hole.

3. A lubrication structure of a camshaft with a variable valve timing, comprising:

an advance hole including an advance flow passage formed in a camshaft body near a sprocket, an end of a camshaft being inserted into a continuously variable valve timing assembly on which the sprocket is provided;

a retard hole including a retard flow passage formed in the camshaft body spaced horizontally from the advance hole; and a divergence flow passage formed on an upper surface of a mounting part of a cylinder head, one end of which is extended so as to be supplied with oil through the retard hole and to supply oil to a counter bore on an inner surface of a cam cap that surface-contacts the mounting part, and the other end of which communicates with a slip surface at an inner side of the cam cap which surface-contacts the outside of the camshaft at the counter bore, so as to prevent lubrication film from being broken by load of the sprocket which is connected to the camshaft at an engine idle state or at an initial stage of cold starting.

4. The lubrication structure of claim 3, wherein the other end of the divergence flow passage is positioned above the advance hole.

5. A lubrication structure of a camshaft with a variable valve timing, comprising:

an advance hole including an advance flow passage formed in a camshaft body near a sprocket, an end of a camshaft being inserted into a continuously variable valve timing assembly on which the sprocket is provided;

a retard hole including a retard flow passage formed in the camshaft body spaced horizontally from the advance hole; and a divergence flow passage, which is formed (i) on an upper surface of a mounting part of a cylinder head to which a slip surface surface-contacts the camshaft and (ii) on a lower surface of a cam cap which is coupled to the upper surface of the mounting part is formed, one end of which is extended toward a counter bore such that oil supplied through the retard hole can flow, and the other end of which communicates with the slip surface of the mounting part and the slip surface of the cam cap, so as to prevent lubrication film from being broken by load of a sprocket which is connected to the camshaft at an engine idle state or at an initial stage of cold starting.

6. The lubrication structure of claim 5, wherein the other end of the divergence flow passage is positioned above the advance hole.

7. A lubrication structure of a camshaft with a variable valve timing, comprising:

an advance hole including an advance flow passage formed in a camshaft body near a sprocket, an end of a camshaft being inserted into a continuously variable valve timing assembly on which the sprocket is provided;

a retard hole including a retard flow passage formed in the camshaft body spaced horizontally from the advance hole; and a divergence hole, one end of which communicates with the retard hole and is extended into an inner side of a cam cap at which a contact surface is formed, and the other end of which opens to a region between the sprocket and the advance hole so as to communicate with the camshaft body.

8. The lubrication structure of claim 7, wherein the divergence hole is formed to have a diameter less than that of the advance hole or the retard hole.

9. A lubrication structure of a camshaft with a variable valve timing, comprising:

an advance hole including an advance flow passage formed in a camshaft body near a sprocket, an end of a camshaft being inserted into a continuously variable valve timing assembly on which the sprocket is provided;

a retard hole including a retard flow passage formed in the camshaft body spaced horizontally from the advance hole; and an auxiliary hole, which is perforated into the camshaft on the retard flow passage, such that oil supplied through the retard hole is supplied to a slip surface of the camshaft.

10. The lubrication structure of claim 9, wherein the auxiliary hole is formed to have a diameter less than that of the retard flow passage.

* * * * *